US009340048B2

(12) United States Patent
Ready et al.

(10) Patent No.: US 9,340,048 B2
(45) Date of Patent: May 17, 2016

(54) INKJET PRINT HEAD HEALTH DETECTION

(71) Applicant: Palo Alto Research Center Incorporated, Palo Alto, CA (US)

(72) Inventors: Steven E. Ready, Los Altos, CA (US); Alan Bell, Mountain View, CA (US)

(73) Assignee: PALO ALTO RESEARCH CENTER INCORPORATED, Palo Alto, CA (US)

( * ) Notice: Subject to any disclaimer, the term of this patent is extended or adjusted under 35 U.S.C. 154(b) by 15 days.

(21) Appl. No.: 13/972,612

(22) Filed: Aug. 21, 2013

(65) Prior Publication Data

US 2015/0054879 A1 Feb. 26, 2015

(51) Int. Cl.

| | |
|---|---|
| ***B41J 2/125*** | (2006.01) |
| ***B41J 29/393*** | (2006.01) |
| ***B41J 2/045*** | (2006.01) |
| *B41J 2/01* | (2006.01) |
| *B41J 2/14* | (2006.01) |

(52) U.S. Cl.

CPC ..... *B41J 29/393* (2013.01); *B41J 2/0451* (2013.01); *B41J 2/04581* (2013.01); *B41J 2/125* (2013.01); *B41J 2002/012* (2013.01); *B41J 2002/14354* (2013.01); *B41J 2202/21* (2013.01)

(58) Field of Classification Search

CPC .... B41J 2/04596; B41J 2/04598; B41J 2/125; B41J 29/393; B41J 2002/14354; B41J 2/0451; B41J 2/04581; B41J 2/16579

USPC ..... 347/19

See application file for complete search history.

(56) References Cited

U.S. PATENT DOCUMENTS

| | | | | |
|---|---|---|---|---|
| 6,375,299 | B1 * | 4/2002 | Foster et al. | 347/19 |
| 7,703,893 | B2 | 4/2010 | Groninger et al. | |
| 2005/0219286 | A1 * | 10/2005 | Nagashima | 347/9 |

* cited by examiner

*Primary Examiner* — Alessandro Amari
*Assistant Examiner* — Scott A Richmond
(74) *Attorney, Agent, or Firm* — Hollingsworth Davis, LLC

(57) ABSTRACT

A method and apparatus for self-sensing the detection of print head conditions on high resolution/multiple nozzle piezoelectric ink jet print heads resulting in increased ink jet efficiency and reduced ejection failure with no use of ink. This is done by creating a pressure wave in an ink-fillable ink jet head ejection chamber where the intensity of the induced pressure wave is below a threshold value necessary to produce ejection of a normal sized ink drop through the nozzle. An electrical signal based on the pressure wave is generated and analyzed to determine ink jet head ink drop ejection performance.

21 Claims, 12 Drawing Sheets

INKJET PRINT HEAD HEALTH DETECTION

TECHNICAL FIELD

This disclosure is related to ink jet printer diagnostics and to systems and methods for performing ink jet printer diagnostics.

BACKGROUND

Ink jet printers operate by using ink ejectors that eject small droplets of liquid ink onto print media according to a predetermined pattern. In some implementations, the ink is ejected directly on a final print media, such as paper. In some implementations, the ink is ejected on an intermediate print media, e.g. a print drum, and is then transferred from the intermediate print media to the final print media. Some ink jet printers use cartridges of liquid ink to supply the ink jets. In some implementations, the solid ink is melted in a page-width print head which jets the molten ink in a page-width pattern onto an intermediate drum. The pattern on the intermediate drum is transferred onto paper through a pressure nip.

The ink jet ejectors of ink jet printers may become blocked by particles or bubbles in the ink or may have other conditions that result in weak, missing or intermittent jetting. These conditions can cause undesirable printing defects.

SUMMARY

Various embodiments described in this disclosure are generally directed to a method for determining the health of an ink jet print head without consuming ink and an apparatus for accomplishing the method.

Some embodiments are directed to a method of determining the health of an ink jet ejector. A piezoelectric drive element of the ejector is energized to induce a pressure wave in an ink-fillable ejection chamber operatively connected to the piezoelectric drive element. The intensity of the induced pressure wave is below a threshold value necessary to produce ejection of a normal sized ink drop by the ejector. In another embodiment, the actuation of the piezoelectric element is designed in terms of shape and intensity specifically for induced pressure sensing and cannot produce an ejected droplet. An ejection chamber fluidic pressure response to the induced pressure wave is sensed and an electrical signal is generated based on the sensing. One or more characteristics of the electrical signal are analyzed to determine ejection performance of the ejector. In some embodiments, an apparatus includes an ink ejector that includes an ink-fillable ejection chamber and a nozzle fluidically connected to ejection chamber. A piezoelectric drive element is coupled to the ejection chamber and is configured to generate a pressure wave below a threshold value necessary to produce an ejection of a normal sized ink drop through the nozzle. A sensor is configured to sense fluidic pressure responsive to the induced pressure wave and to generate an electrical signal based on the sensed fluidic pressure response. An analyzer is configured to analyze one or more characteristics of the electrical signal to determine ejection performance of the ink ejector. In many cases, the sensor is the piezoelectric drive element operated in a sensing mode.

Some embodiments are directed to an ink jet printer that incorporates a system for ejector diagnostics. The ink jet printer comprises a print head including a plurality of ejectors. Each ejector includes an ink-fillable ejection chamber, a nozzle fluidically connected to the ejection chamber, and a piezoelectric element coupled to the ejection chamber. The piezoelectric element can generate a pressure wave below a threshold value necessary to produce an ejection of a normal sized ink drop through the nozzle. The system further includes a sensor configured to sense an ejection chamber fluidic pressure responsive to the induced pressure wave and to generate an electrical signal based on the sensed fluidic pressure response. An ejector control unit is configured to control the piezoelectric drive elements of the plurality of ejectors. An analyzer is configured to analyze one or more characteristics of the electrical signals generated by the piezoelectric elements to determine print head ejection performance based on the characteristics of the signals.

BRIEF DESCRIPTION OF THE DRAWINGS

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Figure 1A:
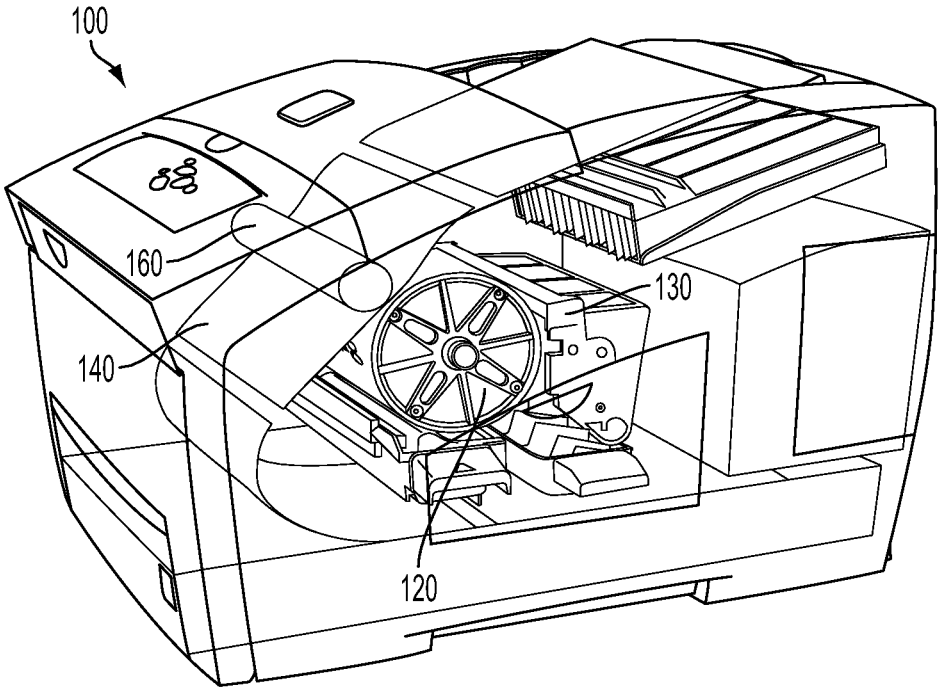
FIGS. 1A and 1B are diagrams of an ink jet printer that incorporates ejector diagnostic components and processes as described in embodiments herein.

In high resolution multiple nozzle piezoelectric ink jet print heads, most or substantially all ejectors need to perform adequately so that droplets are placed on the receiving media in accordance with printer specifications. Several things can go wrong that interferes with droplet ejection, such as nozzle blockage, insufficient ink supply to the ejection chamber, gas bubbles in the ejection chamber and ink supply channels, and front face wetting of the ink jet heads.

Embodiments described herein involve diagnostic approaches for the detection of print head conditions that may lead to reduced ejection efficiency of the ejectors. According to embodiments described herein, a pressure wave insufficient to eject a normal sized ink drop is created in the ejector ejection chamber. The generated pressure wave creates a fluidic pressure response in the ejector. The fluidic pressure response is sensed and converted to an electrical signal. The electrical signal corresponding to the fluidic pressure response is analyzed to identify the condition of the ink jet. According to embodiments described herein, the pressure wave generated in the ejector is insufficient to eject a normal sized ink drop. The term "normal sized ink drop" is an ink drop that is useful for ink jet printing. In some embodiments, the pressure wave generated in the ejector is insufficient to eject ink from the ejector.

When ink is ejected to diagnose ejector health, the amount of ink used for diagnostic purposes is wasted. Moreover, ejection of ink during testing may lead to additional components or processes for discarding the ejected diagnostic ink. For example, if the diagnostic ink is ejected onto a test sheet, after testing, the test sheet needs to be discarded. If the diagnostic ink goes into a gutter on the print head or elsewhere in the system, then a container may be needed to collect the ejected diagnostic ink. The use of sub-threshold ejection testing as described herein reduces waste and reduces system complexity.

In some embodiments, the pressure wave is generated by the piezoelectric transducer (PZT) of the ejector and the fluidic pressure response is sensed by the same ejector PZT that generates the pressure wave. Embodiments that use the PZT of the ejector for sensing the fluidic response are referred to herein as "self-sensing." In some implementations, the ejector diagnostic approaches described herein are performed "on-the-fly," meaning that generating the pressure wave and sensing the fluidic response are performed between the printing of pages and/or when the pattern to be printed calls for unprinted "white" rows. by the ink jet printer. In some embodiments, the ink jet printer may include a control element that is capable of generating an error message and/or turning the ink jet printing function off in response to detecting problems with the print head ejectors. For example, a problem with the print head may be detected when the diagnostic approaches discussed herein indicate that one or more ejectors of the print head have conditions that may cause weak, missing and/or intermittent ink jetting leading to a number of print defects exceeding a predetermined threshold for print quality.

Figure 1B:
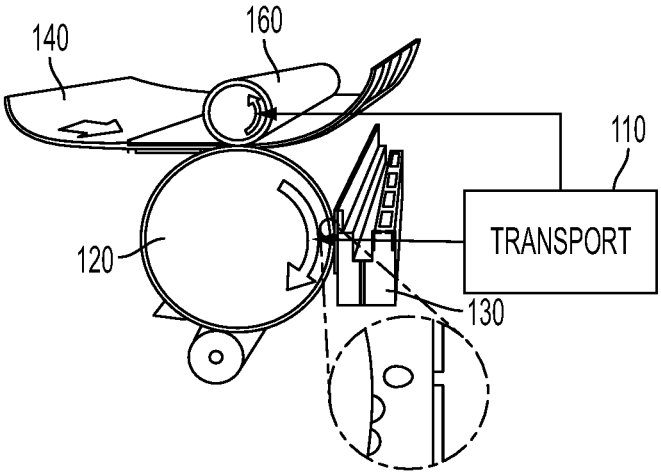

Embodiments discussed herein involve ejector diagnostic approaches that rely on inducing a pressure wave in an ejector insufficient to eject a normal sized drop (or any drop) from the ejector. The fluidic pressure response of the ejector in response to the induced pressure wave is sensed. An electrical signal corresponding to the fluidic pressure response is analyzed to diagnose ejector problems. FIGS. 1A and 1B provide internal views of portions of an ink jet printer 100 that can be used to implement the ejector diagnostic approaches according to embodiments discussed herein. The printer 100 includes a transport mechanism 110 that is configured to move the drum 120 relative to the print head 130 and to move the paper 140 relative to the drum 120. The print head 130 may extend fully or partially along the length of the drum 120 and includes a number of ink jets. As the drum 120 is rotated by the transport mechanism 110, ejectors of the print head 130 deposit droplets of ink though ejector apertures onto the drum 120 in the desired pattern. As the paper 140 travels around the drum 120, the pattern of ink on the drum 120 is transferred to the paper 140 through a pressure nip 160.

Figure 2A:
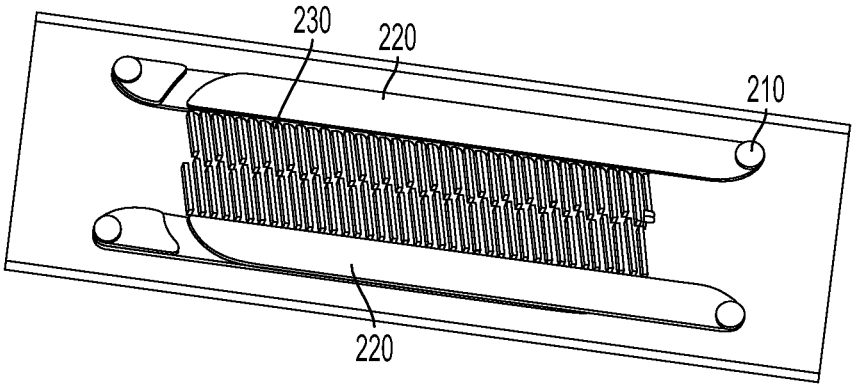
FIGS. 2A and 2B are diagrams of the print head of the ink jet printer of FIG. 1.
Figure 2B:
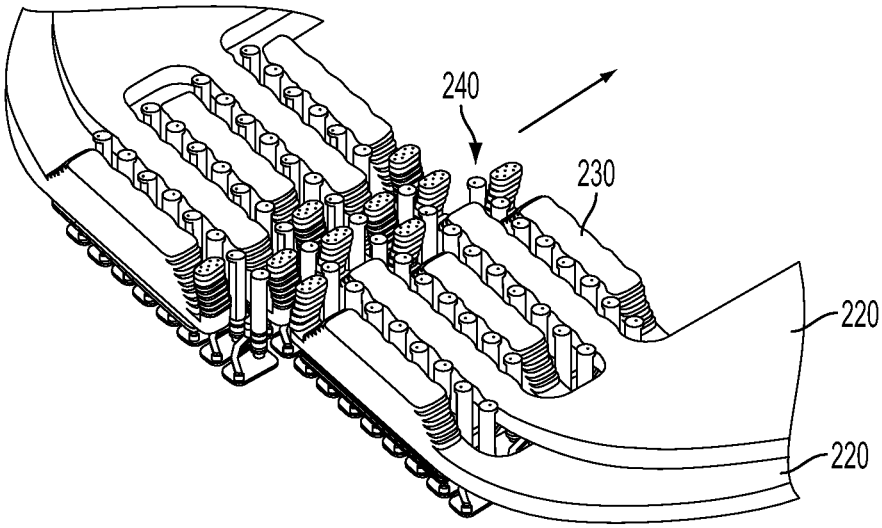

FIGS. 2A and 2B provide more detailed views of an exemplary print head. The path of ink, contained initially in a reservoir, flows through a port 210 into a main manifold 220 of the print head. As best seen in FIG. 2B, in some cases, there are four main manifolds 220 which are overlaid, one manifold 220 per ink color, and each of these manifolds 220 connects to interwoven finger manifolds 230. The ink passes through the finger manifolds 230 and then into the ink jets 240. The manifold and ink jet geometry illustrated in FIG. 2B is repeated in the direction of the arrow to achieve a desired print head length, e.g. the full width of the drum. It will be appreciated that the specific configurations of the ink jet printer 100 and print head illustrated in FIGS. 1-2 are provided as examples, and that ink jet printers and/or ink jet print heads have a variety of configurations applicable to the diagnostic approaches discussed herein.

Figure 3:
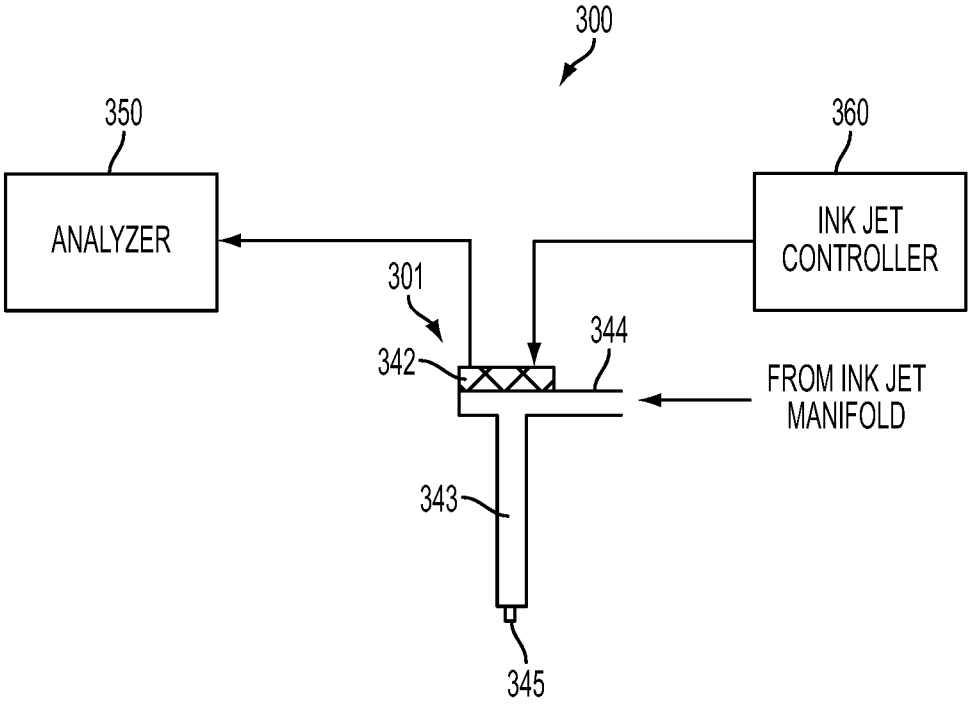
FIG. 3 is a block diagram of an apparatus for ejector diagnostics in accordance with embodiments described herein.

FIG. 3 is a block diagram of an ejector testing system 300 in accordance with some embodiments. The testing system 300 is illustrated using a single ejector, however, it will be appreciated that most ink jet print heads include multiple ejectors and that the system 300 can be configured to analyze and diagnose a multiple ejector print head. For example, each of the multiple ejectors or a sample of the ejectors of a print head can be tested between printing pages and/or when the pattern to be printed calls for unprinted "white" rows using a testing system similar to the system 300 illustrated in FIG. 3. As shown in FIG. 3, each ejector 301 includes an actuator, such as PZT actuator 342, that can be electrically activated to induce a pressure wave within the ejection chamber 344 and nozzle 343. The PZT actuator 342 is activated by a signal from ejector controller 360. When the ejector 300 is used for ink jet printing, the ejector controller 360 provides a signal that activates the PZT 342 to generate a pressure wave in the ejection chamber 344 sufficient to cause ejection of an ink drop through the nozzle 343 and ejector aperture 345. During diagnostic testing, the ejector controller activates the PZT 342 to generate a pressure wave in the ejection chamber that does not result in ejection of ink, or results in ejection of a sub-normal sized ink drop when compared to an ink drop used for printing. For example, the pressure used for diagnostic testing may be in a range of about 20% to about 60% of the pressure used for ink jet printing.

When operating in a self-sensing testing mode, after the PZT 342 induces the pressure wave in the ejection chamber 344, the PZT 342 is used in a sensing mode as a sensor to convert the fluidic pressure response of the ejection chamber 344 to an electrical signal. The fluidic pressure response may be a signal having frequencies in the range of about 20 kHz to about 400 kHz, for example. Analyzer 350 analyzes the electrical signal from the PZT 342 in the time domain and/or frequency domain to identify the condition of the ejector 300.

In some embodiments, the drive signal from the ink jet controller 360 to the PZT 342 has signal morphology characteristics that enhance the sensed fluidic pressure response for ejector testing. For example, the drive signal morphology may be tailored to increase the signal to noise ratio (SNR) of the sensed signal and/or may be selected to enhance a desired resonance frequency behavior. Drive signal morphology characteristics that may be adjusted to enhance the sensed fluidic pressure response can include signal characteristics such as frequency, duty cycle, rise time, fall time, pulse width, pulse amplitude, pulse shape, e.g., sinusoidal, square, triangular, sawtooth etc. As such, the signal morphology of the drive signal used for ink jetting may be different from the signal morphology of the drive signal used for sub-threshold ink ejector testing.

The analyzer 350 may apply various signal processing techniques to the signal generated by the PZT 342 prior to analysis. The signal processing may include amplifying, filtering and/or converting the analog signal to digital form, for example. Analysis of the signal to determine the condition of the ink jet may involve time domain analysis, frequency domain analysis, or a combination thereof.

Various conditions may affect ejection performance, such as a fully or partially blocked jet, viscosity of the ink, the presence of gas bubbles in the ejection chamber and/or print head manifolds, insufficient ink supply to the ejection chamber, ink viscosity, and/or front face wetting of the print head, among other conditions. Each of these conditions changes the fluidic pressure response of the ejection chamber. The fluidic pressure response of the ejector to an induced pressure wave can be analyzed for various signatures that identify these and other conditions.

Figure 4:
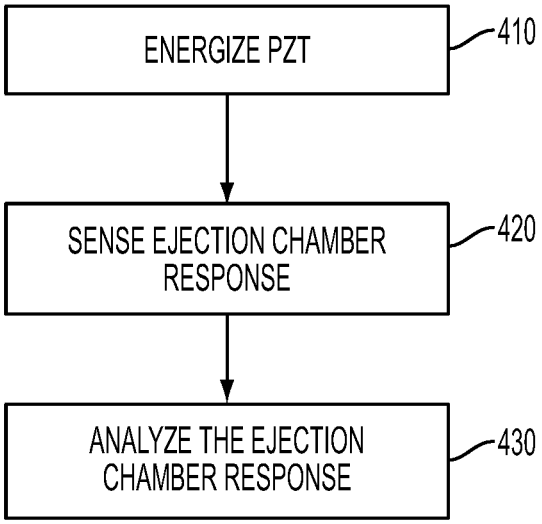
FIG. 4 is a flow diagram illustrating an ejector diagnostic process according to various embodiments discussed herein.

FIG. 4 is a flow diagram of processes that may be implemented by the system 300 shown in FIG. 3, for example. The PZT 342 is energized 410 by the ejector controller 360 to induce a pressure wave in the ejection chamber 344. The induced pressure wave has an intensity that is below a threshold value necessary to produce ejection of ink (e.g., below the threshold value needed to eject a normal sized drop or below the threshold value needed to eject any ink) from the ejection chamber 344. The ejection chamber fluidic pressure response to the induced pressure wave creates an electrical charge variation produced by the PZT due to the varying pressure inside the ejection chamber. The electrical charge variation is sensed 420 and one or more characteristics of this electrical signal are analyzed 430 to determine ejection performance.

In some embodiments the process steps of energizing, sensing, and analyzing are performed at regular intervals. Because at least the energizing and sensing is able to occur over a short span of time, these portions of the diagnostic testing of the print heads may be done at regular intervals between the printing of successive pages. The energizing and sensing could take place between the printed pages, just prior to a page run, and/or when the pattern to be printed calls for unprinted "white" rows.

For example, for print heads capable of printing one or more rows at a time, ejector diagnostics may be performed during times that the pattern to be printed calls for at least one unprinted "white" row. On many pages, the print pattern is relatively sparse and calls for nothing to be ejected for one or more rows on the page. These unprinted "white" rows could be used for ejector diagnostics using the diagnostic processes described herein. Because these processes do not produce ejection of ink, the diagnostic process would not print on the print page. According to these embodiments, ejector diagnostics could be performed throughout the printing process. The print controller can be configured to dynamically determine which rows are unprinted, "white" rows and to coordinate the sub-threshold ejection testing with the unprinted rows.

In some embodiments, energizing, sensing and analyzing can all be accomplished between printed pages, just prior to a page run, and/or when the pattern to be printed calls for unprinted "white" rows. The diagnostic approaches described herein allow the per-ejector health of a print head to be determined very rapidly and without ejection of ink.

The pressure used for the diagnostic testing is sufficient to induce the pressure wave in the ejection chamber but is insufficient to eject an ink drop. The specific pressure that remains within these constraints depends on a number of factors that can be interrelated. These factors may include for example, the physical configuration of the ejector, e.g., physical configuration of the ejection chamber, ejector nozzle, aperture, and/or ink jet manifolds. The factors may also include the physical characteristics of the ink, e.g., phase change ink or ink that is liquid at room temperature, the viscosity and temperature of the ink during ejection. Generally the energy level used to induce the pressure wave can be anywhere between just below that needed to eject a drop of ink to just above the value able to be detected and characterized by an analyzer. In some embodiments, this is an energy level of between 80 percent and 30 percent of the energy level required to eject a normal sized ink drop. In some embodiments this level is more than 80 percent but less than 100 percent. In some embodiments this level is less than 30 percent.

Figure 5A:
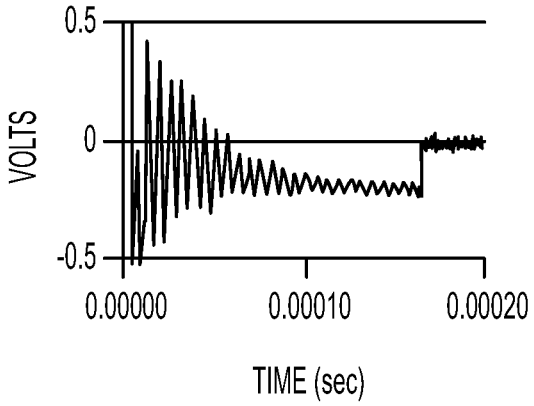
FIGS. 5A-5C show electrical waveforms representing various ejector conditions that may be detected using the approaches discussed herein.
Figure 5B:
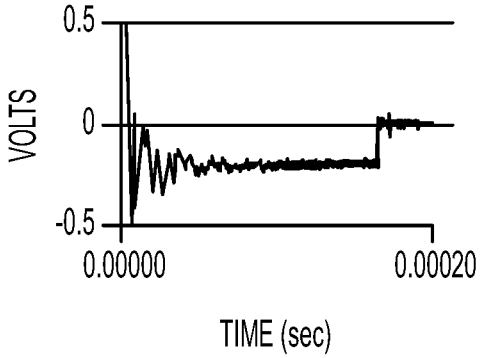
Figure 5C:
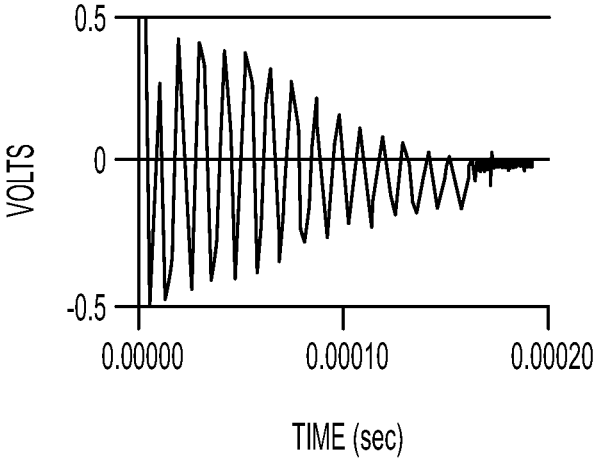

FIGS. 5A, 5B, 5C illustrate characteristic time domain damped resonance signal waveforms produced by self-sensing the ejector response to an induced pressure wave. These waveforms are representative of the fluidic response to an induced pressure wave for various ejector conditions. FIG. 5A is characteristic of a healthy ejector. FIG. 5B illustrates a characteristic waveform that occurs when the ejector is blocked. FIG. 5C illustrates a characteristic signal that occurs when a gas bubble is present in the ejector chamber or nozzle. The analyzer may be configured to calculate the correlation coefficient between a characteristic waveform such as the waveforms illustrated in FIGS. 5A-5C for a particular type of ejector and to determine the condition of the ejector based on the correlation coefficient.

Figure 6:
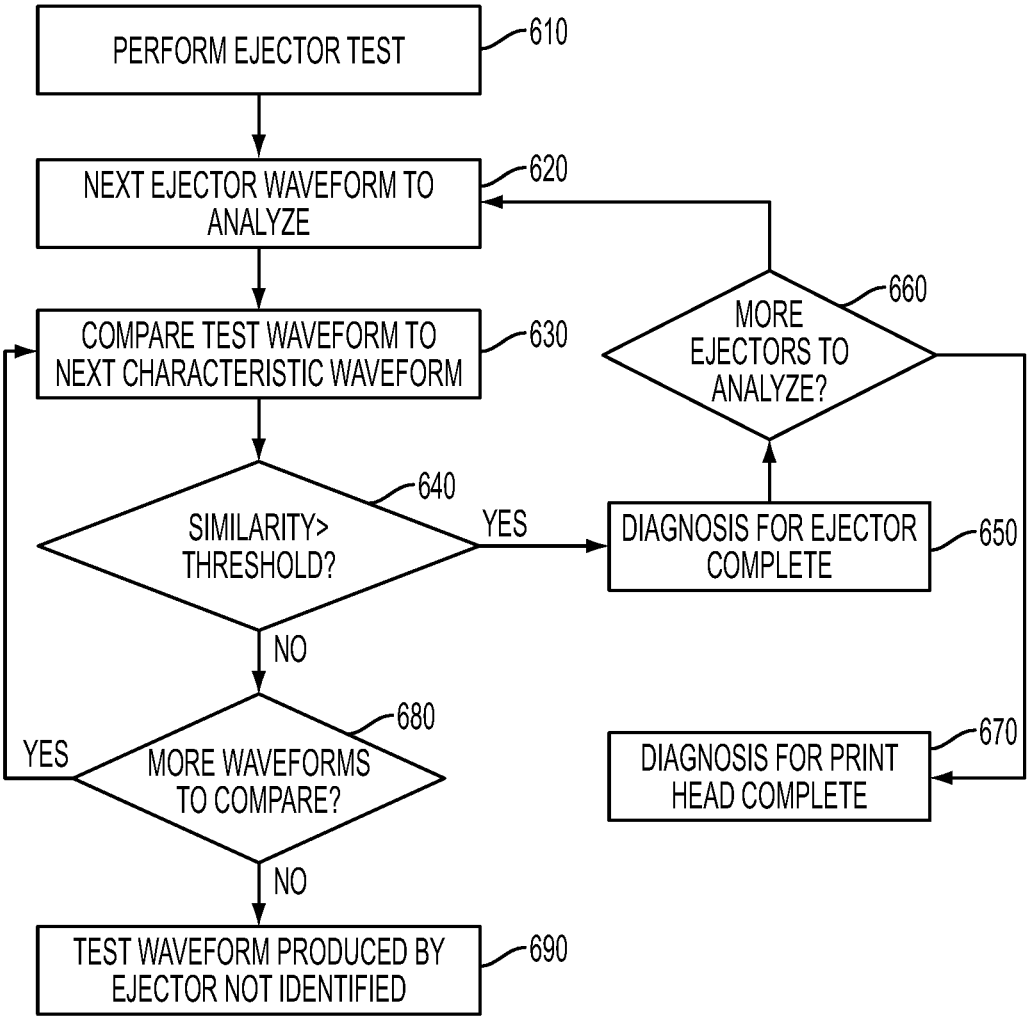
FIG. 6 is a flow diagram illustrating a process of diagnosing one or more ejectors by comparison of the fluidic response signal of the ejectors to one or more characteristic waveforms in accordance with some embodiments.

FIG. 6 is a flow diagram illustrating a process that may be implemented by the system to diagnose a print head having a number of ejectors. In some scenarios, a number of characteristic waveforms associated with different ejector conditions, e.g., time domain characteristic fluidic responses for conditions such as normal, blocked, gas bubble presence as illustrated in FIGS. 5A-5C, may be stored in the memory of the analyzer. In other scenarios, the analyzer may develop a group of one or more characteristic waveforms during an initialization process. Optionally, the analyzer may identify one or more additional characteristic waveforms associated with one or more additional ejector conditions and add the additional characteristic waveform to the group.

A diagnostic test 610 is performed that includes inducing a pressure wave in each ejector of the print head and sensing the fluidic pressure response for each ejector. The waveform of the fluidic pressure response is obtained from each ejector is compared 630 to one or more characteristic waveforms in the group of characteristic waveforms. In some implementations, for example, the comparison may include calculating a correlation coefficient between the characteristic waveform and the test waveform. If the similarity between the ejector test waveform and the characteristic waveform is greater than 640 a threshold value, then the condition of that ejector has been identified and the diagnosis for that ejector is complete 650. If there are more 660 ejector test waveforms to analyze then the analyzer proceeds to analyze 660 the waveform for each additional ejector until the diagnosis for the entire print head is complete 670.

However, if the similarity between the ejector test waveform and the characteristic waveform is not greater 640 than the threshold and if there are more 680 characteristic waveforms to compare, the analyzer compares 630 the next characteristic waveform to the ejector test waveform. This process continues until all characteristic waveforms have been compared to the test waveform. In some cases, the test waveform produced by the ejector may not match any of the characteristic waveforms and the analyzer is unable to identify 690 the condition of the ejector.

In some implementations, the analyzer may be configured to add additional characteristic waveforms as it "learns" different ejector conditions. For example, the analyzer may add the unidentified test waveform to the group as a new characteristic waveform. The next ejector waveform will be compared to the characteristic waveforms in the group that now includes the new characteristic waveform. In some cases, the new characteristic waveform may be presented to an operator who can input a descriptive label that is associated the new characteristic waveform.

Figure 7:
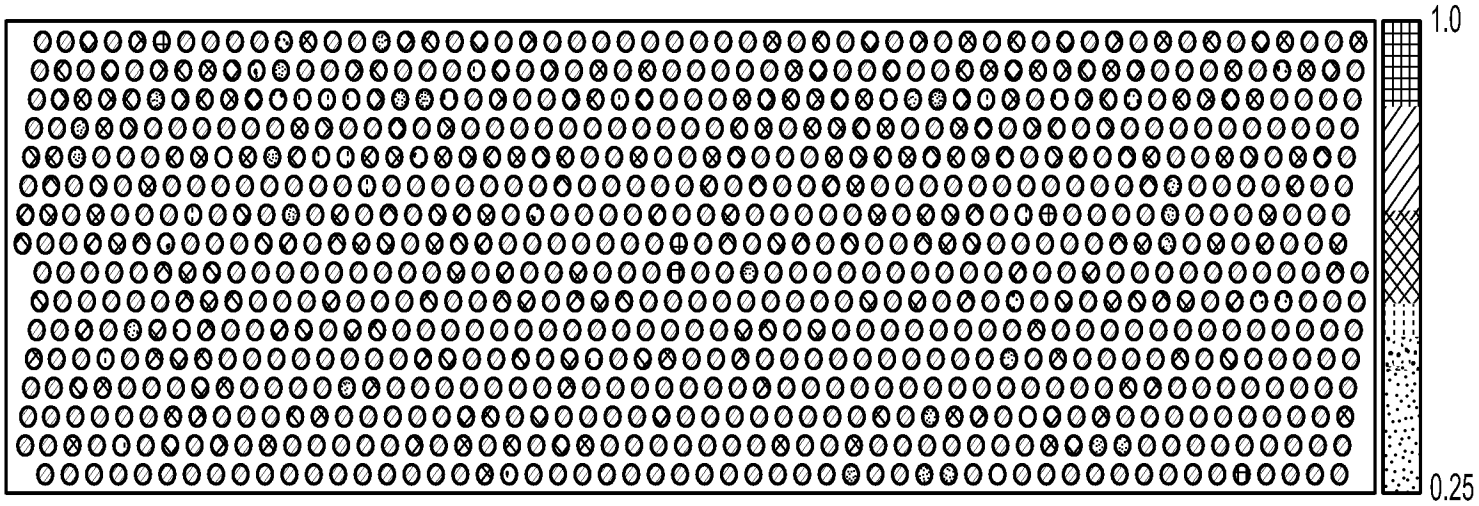
FIG. 7 illustrates the results of diagnosing a print head having multiple ejectors using the diagnostic approaches of various embodiments discussed herein.

FIG. 7 provides the result of an ejector test for a print head shown by a correlation map of the print head under test. In this example, a healthy ejector was specified as one having a correlation factor with the characteristic normal waveform above 90%. As depicted in FIG. 7, the correlation factor scale for ranges from 85 to 100%. Any ejector having a correlation factor to the characteristic normal waveform below 85% is shown as white in FIG. 7.

Figure 8:
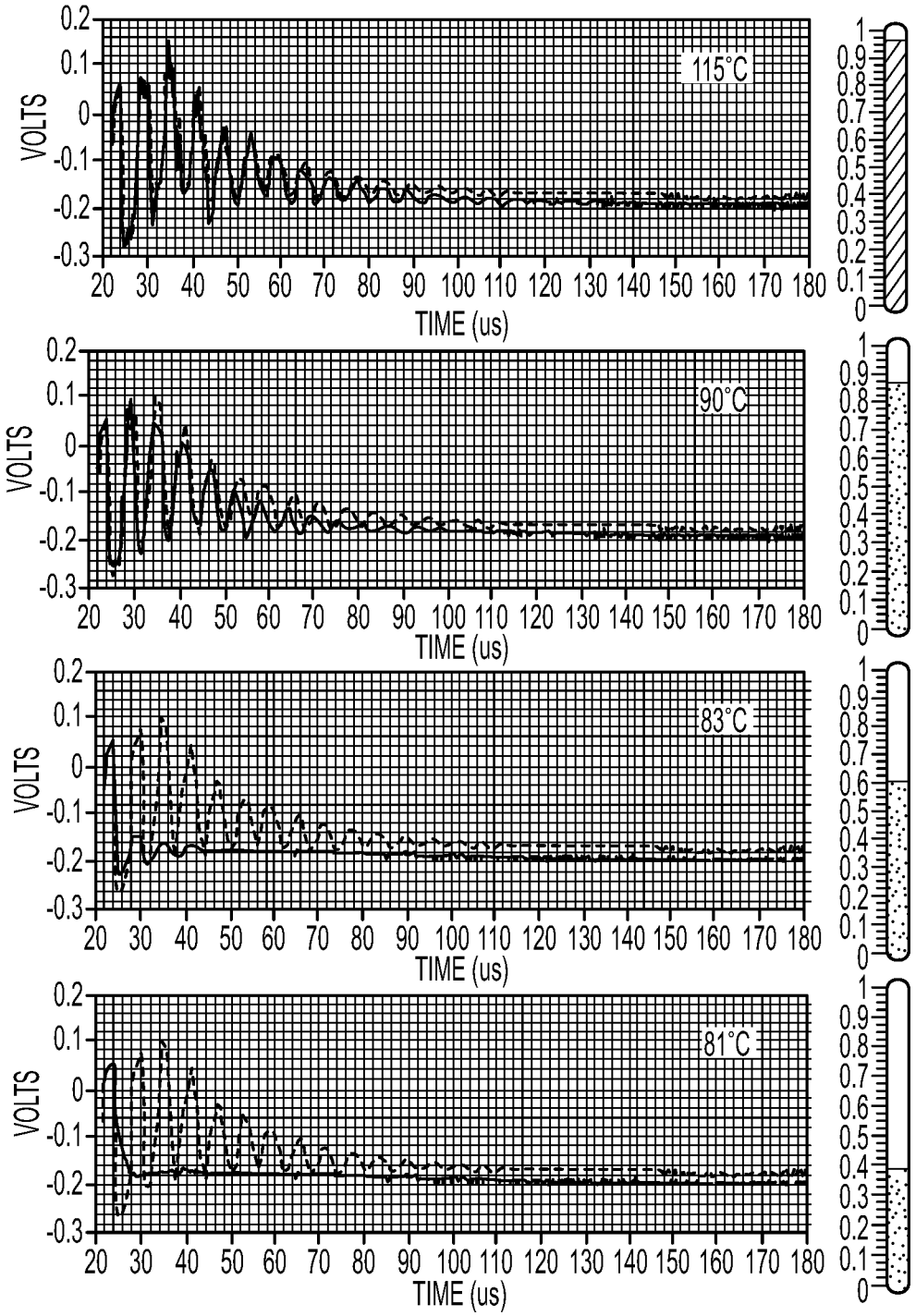
FIG. 8 shows graphs of the time domain fluidic response signal of an ejector responsive to an induced pressure wave, the graphs illustrating the change in the fluidic response signal with ink temperature.

FIG. 8 is a graph demonstrating the change ejector fluidic response waveforms as the viscosity of a phase change ink changes with temperature. The fluidic response produces the illustrated time domain damped resonance waveforms of FIG. 8. These waveforms were generated at four temperatures of ink in the ejection chamber, 115° C., 90° C., 83° C., and 81° C. Each graph shown in FIG. 8 compares the waveform for good (normal) jetting conditions and the waveforms for the temperature indicated. The scales on the right side of the graphs indicate the calculated correlation between the good jetting waveform (dashed lines) and the waveform under test (solid lines). For this particular ink and ink jet print head configuration, the analysis shows the temperatures where the viscosity of the ink is adequate for good jetting, 115° C., the temperature where the viscosity was beginning to cause troublesome jetting, 90° C., and those temperatures where jetting was unsatisfactory, 83° C., and 81° C.

Figure 9A:
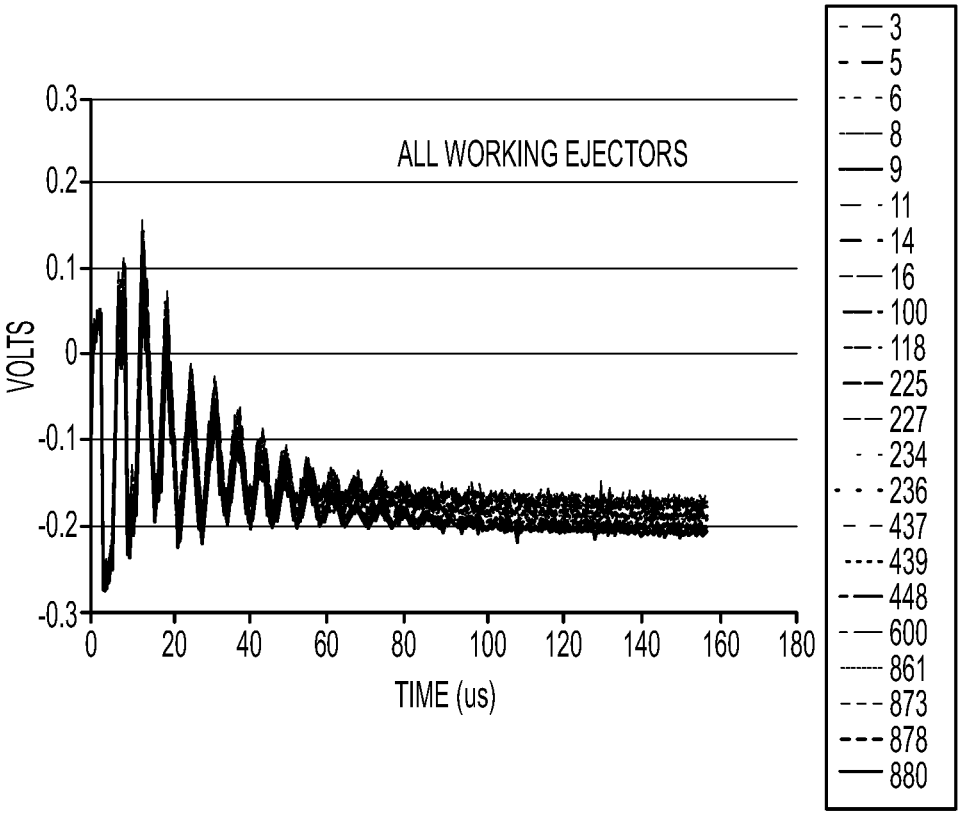
FIGS. 9A-9D show graphs of time domain and frequency domain response signals that can be used to analyze ejector health in accordance with various embodiments.
Figure 9B:
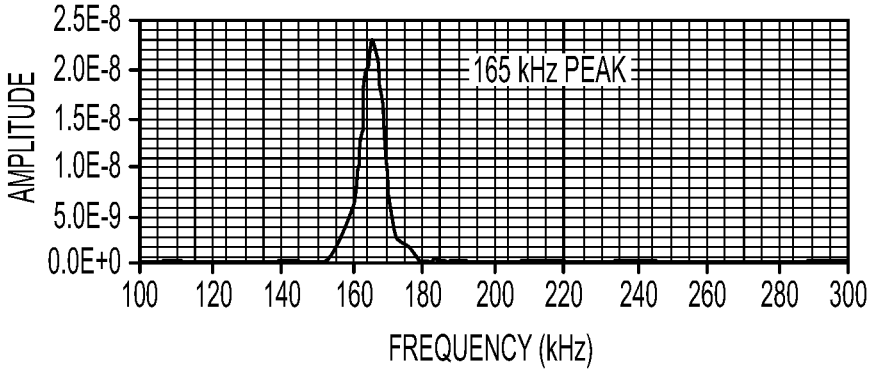

The fluidic response of an ejector has a characteristic resonant frequency that may shift or change under certain conditions. The characteristic resonant frequency of the ejector having normal or problematic conditions can be compared to the resonant frequency of a test waveform to diagnose the condition of the ejector. FIGS. 9A-9D provide graphs showing working ejectors and non-working ejectors with two ways of analyzing the resonance data, by time domain damped resonance analysis and by Fast Fourier Transform (FFT) central peak frequency and/or peak width analysis. FIG. 9A is a graph of the time domain damped resonance signals of properly working ejectors with the corresponding FFT response shown in FIG. 9B. The FFT in FIG. 9B shows a relatively narrow frequency peak near 165 kHz in this example.

Figure 9C:
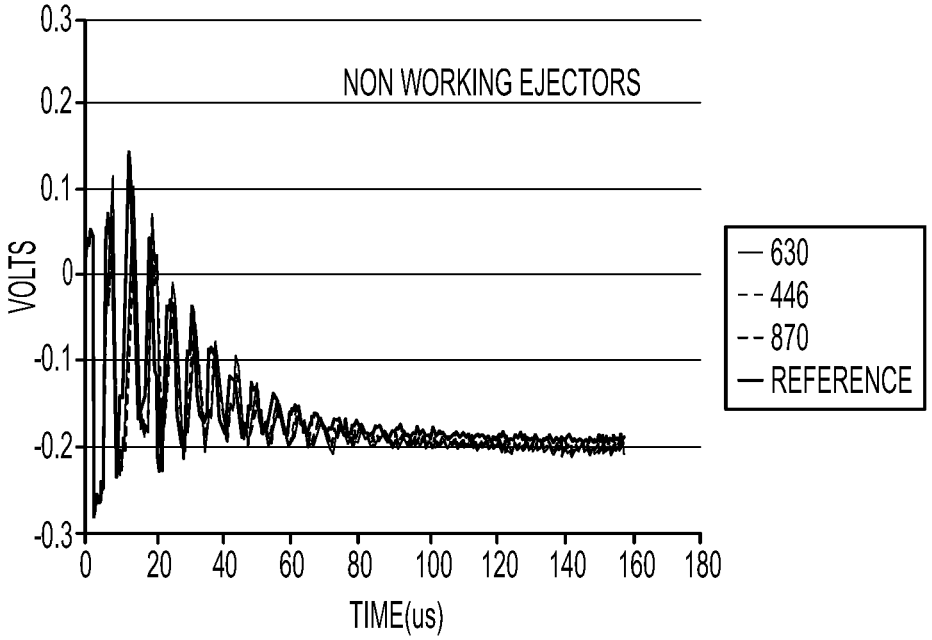
Figure 9D:
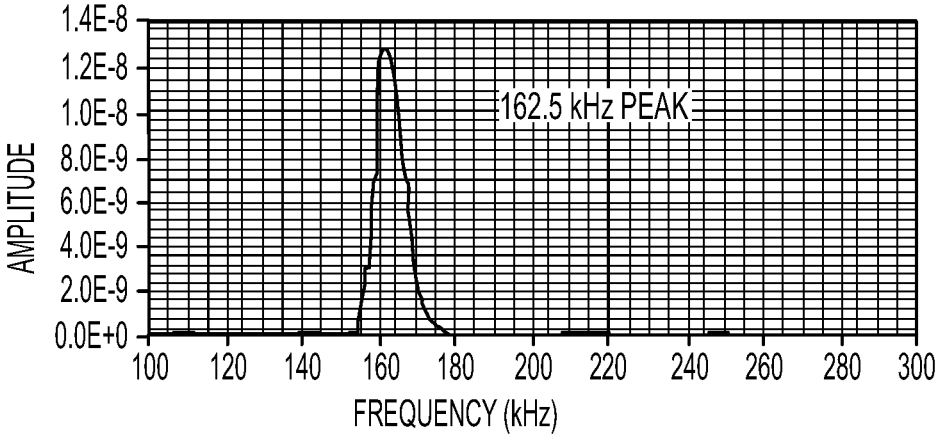

FIG. 9C is a graph of the time domain damped resonance signals of non-working ejectors with corresponding FFT response shown in FIG. 9D. The FFT response shown in FIG. 9D has a wider peak and a shift to a lower central frequency, 162.5 kHz when compared to the normal FFT response shown in FIG. 9B. The shift in resonant frequency and/or change in the width of the resonant frequency peak is an indication of non-functioning or sub-normal functioning of the ejectors.

Figure 10:
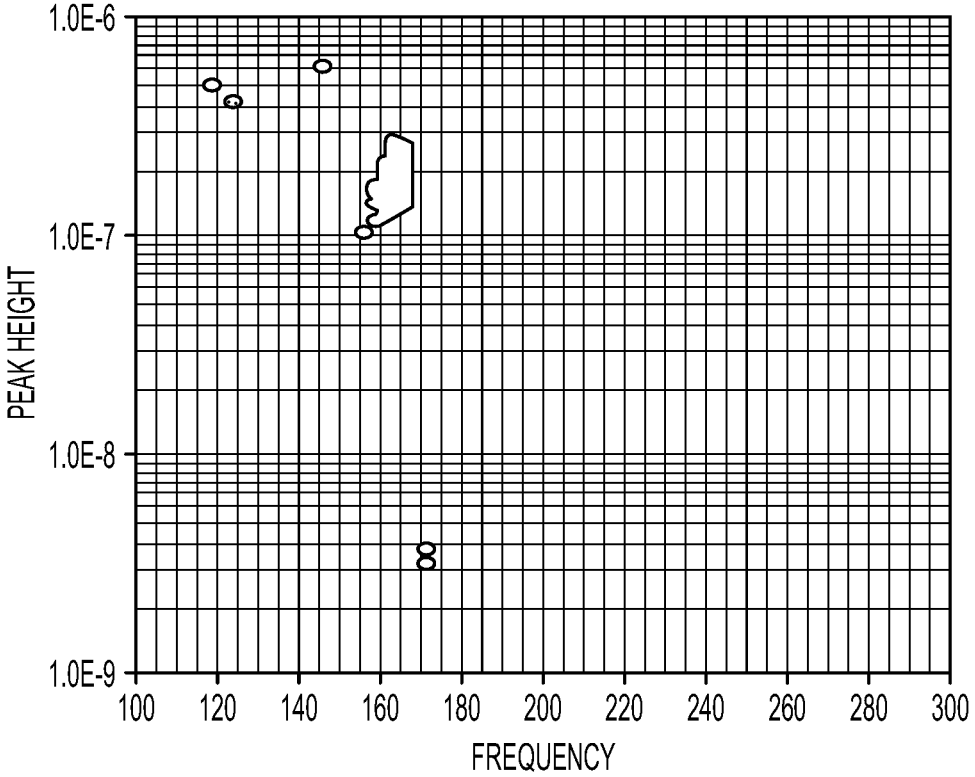
FIG. 10 shows clustering of Fast Fourier Transform (FFT) peak heights and frequencies for the healthy ejectors and outlying problem ejectors of a print head diagnosed using the approaches described herein.

FIG. 10 illustrates a frequency vs. FFT peak height map of 880 ejectors. The healthy ejectors have FFT peaks clustered around 160 kHz-170 kHz. Ejectors with significant different peak heights and/or significantly different peak central frequencies can be identified by their placement on this plot indicative of the cause of their problem. Most of the ejectors are clustered between 160 and 170 kHz which is a reasonably operative range, though a healthy print head in this example would have all the ejectors operating very near a single frequency, usually 165.7 kHz.

Print head testing as described herein may be implemented under the control of an analyzer that individually actuates the ejectors of the print head in succession while recording the resonance responses through test electronics which isolates, amplifies and digitizes the signal. Embedding the electronics, digitization and analysis algorithms in the print head electronics can reduce the acquisition and analysis time for an 880 ejector print head to less than about 200 ms or even less than 100 ms, e.g., less than about 0.25 ms per ejector or even less than about 0.1 ms per ejector.

The embodiments described herein comprise an ink-fillable ink ejector that includes an ejection chamber, an ejector nozzle, a piezoelectric element used for ink ejection and optionally as a sensor in a self-sensing mode, a piezoelectric drive controller, and an analyzer. For non-self-sensing embodiments, a sensor separate from the ejector PZT may be used. The nozzle is fluidically connected to ejection chamber. The piezoelectric element is coupled to the ejection chamber and is configured to generate a pressure wave below a threshold value necessary to produce ejection of a normal sized ink drop through the nozzle. The sensor is configured to sense an ejection chamber fluidic pressure response to the induced pressure wave and to generate an electrical signal based on the sensed fluidic pressure response. The analyzer is configured to analyze one or more characteristics of the electrical signal to determine ink jet head ink drop ejection performance.

The analysis approaches may be used to diagnose ink jet print heads of various resolution and nozzle number configurations. The analysis approaches discussed herein may be particularly useful to diagnose high resolution/multiple nozzle ink jet heads that are often associated with higher quality images.

The analyzer is configured to analyze at least one characteristic of the electrical signal to determine the ink drop ejection performance of the ink jet head. Thus, it is designed to detect at least one ejection problem from a list that includes, for example, one or more of nozzle blockage, insufficient ink supply to the ejection chamber, gas bubbles in the ejection chamber and ink supply channels, and wetting of the front face of the ink jet nozzle. The electrical characteristics associated with these problems can be observed in various forms that include, for example, time domain comparison to a known satisfactory signal, Fast Fourier Transform (FFT) central peak frequency, magnitude of oscillation damping, or FFT peak width. In some embodiments, the analyzer is further configured to stop the printing if an adverse problem arises and to send an error message regarding next steps that should be performed.

The diagnostic system is able to perform the ink ejector health determination of an ink jet print head relatively rapidly. In some embodiments, the apparatus is configured to generate the pressure wave, sense the fluidic pressure response, and analyze the signal in less than about 100 ms. This speed and lack of ink ejection permits the system to perform the ejector health check when the pattern to be printed calls for unprinted "white" rows, between pages, and/or at the beginning or end of a run. Such speed permits the system to perform the health testing routinely, thus reducing the number of unsatisfactory printed pages and/or amount of ink used for detecting ejector health.

The following are a list of embodiments in this disclosure.

Item 1. A method, comprising:

energizing a piezoelectric drive element of an ejector to induce a pressure wave in an ink-fillable ejection chamber of the ejector, an intensity of the induced pressure wave being below a threshold value necessary to produce ejection of a normal sized ink drop by the ejector;

sensing a fluidic pressure response to the induced pressure wave and generating an electrical signal based on the sensing; and analyzing one or more characteristics of the electrical signal to determine ejection performance of the ejector.

Item 2. The method of item 1 wherein the ink jet head is a high resolution/multiple nozzle ink jet head.

Item 3. The method of any of items 1 through 2, wherein sensing the fluidic pressure response comprises self-sensing using the piezoelectric drive element.

Item 4. The method of any of items 1 through 3 wherein analyzing characteristics of the signal comprises detecting at least one of ink viscosity, nozzle blockage, insufficient ink supply to the ejection chamber, gas bubbles in the ejection chamber and ink supply channels, and wetting of the front face of the ink jet nozzle.

Item 5. The method of any of items 1 through 4 wherein analyzing the characteristics of the signal comprises analyzing the signal in at least one of time domain and frequency domain.

Item 6. The method of any of items 1 through 5 wherein the characteristics comprise at least one of time domain comparison to a known satisfactory signal, Fast Fourier Transform (FFT) central peak frequency, magnitude of oscillation damping, or FFT peak width.

Item 7. The method of any of items 1 through 6, wherein the energizing, sensing, and analyzing are performed during a time interval that occurs between printing of successive pages or when the pattern to be printed calls for unprinted rows.

Item 8. The method of any of items 1 through 7, wherein the energizing, sensing, and analyzing are performed for an ink jet print head having about 880 nozzles during a time interval that occurs between printing of successive pages, the time interval being less than about 100 ms.

Item 9. The method of any of items 1 through 8, wherein analyzing further includes stopping the printing if an adverse problem is detected and sending an error message.

Item 10. The method of any of items 1 through 9, wherein energizing the piezoelectric drive element to induce a pressure wave comprises energizing the piezoelectric drive element at an energy level that is between about 80 percent and 20 percent of the energy level required to eject a normal sized ink drop.

Item 11. The method of any of items 1 through 10, wherein energizing the piezoelectric drive element to induce a pressure wave comprises modifying the time and voltage shape of a drive signal that energizes the piezoelectric drive element to provide optimal sensing of the fluidic pressure response and analysis of the one or more characteristics of the electrical signal.

Item 12. An apparatus, comprising:

an ink-fillable ejection chamber of an ink ejector;

a nozzle fluidically connected to ejection chamber;

a piezoelectric drive element coupled to the ink jet head ejection chamber and configured to generate a pressure wave below a threshold value necessary to produce an ejection of a normal sized ink drop through the nozzle;

a sensor configured to sense an ejection chamber fluidic pressure response to the induced pressure wave and to generate an electrical signal based on the sensed fluidic pressure response; and an analyzer configured to analyze one or more characteristics of the electrical signal to determine ejection performance of the ink ejector.

Item 13. The apparatus of item 12, wherein the sensor is the piezoelectric drive element operated in a sensing mode.

Item 14. The apparatus of any of items 12 through 13, wherein the analyzer is configured to detect at least one of ink viscosity, nozzle blockage, insufficient ink supply to the ejection chamber, gas bubbles in the ejection chamber and ink supply channels, and wetting of the front face of the ink jet nozzle.

Item 15. The apparatus of any of items 12 through 14 wherein the apparatus is configured to generate the pressure wave, sense the fluidic pressure response, and analyze the signal in less than about 100 ms.

Item 16. The apparatus of any of items 12 through 15 wherein the analyzer is configured to compare the electrical signal to a time domain characteristic waveform to determine the ejection performance.

Item 17. The apparatus of any of items 12 through 15, wherein the analyzer is configured to compare the electrical signal to a frequency domain signal to determine the ejection performance.

Item 18. The apparatus of any of items 1 through 15, wherein the analyzer is configured to compare one or both of a peak frequency or peak width of a Fast Fourier Transform (FFT) of the electrical signal to a predetermined threshold to determine the ejection performance.

Item 19. An ink jet printer print head, comprising:

a print head including a plurality of ejectors, each ejector comprising:

an ink-fillable ejection chamber;

a nozzle fluidically connected to ejection chamber;

a piezoelectric element coupled to the ejection chamber and configured to generate a pressure wave below a threshold value necessary to produce an ejection of a normal sized ink drop through the nozzle, to sense an ejection chamber fluidic pressure responsive to the induced pressure wave, and to generate an electrical signal based on the sensed fluidic pressure response;

an ejector control unit configured to control the piezoelectric drive elements of the plurality of ejectors; and an analyzer configured to analyze one or more characteristics of the electrical signals generated by the piezoelectric elements of the plurality of ejectors to determine print head ejection performance.

Item 20. The print head of item 19, wherein the analyzer is configured to compare the electrical signal of each ejector to one or more known time domain characteristic waveforms to determine the print head ejection performance.

Item 21. The print head of item 19, wherein the analyzer is configured to compare one or both of a peak frequency or peak width of a Fast Fourier Transform (FFT) of the electrical signal of each ejector to a predetermined threshold to determine the print head ejection performance.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

The various embodiments described above may be implemented using circuitry and/or software modules that interact to provide particular results. One of skill in the computing arts can readily implement such described functionality, either at a modular level or as a whole, using knowledge generally known in the art. For example, the flowcharts illustrated herein may be used to create computer-readable instructions/code for execution by a processor. Such instructions may be stored on a computer-readable medium and transferred to the processor for execution as is known in the art. The structures and procedures shown above are only a representative example of embodiments that can be used to facilitate ink jet ejector diagnostics as described above.

The foregoing description of the example embodiments have been presented for the purposes of illustration and description. It is not intended to be exhaustive or to limit the inventive concepts to the precise form disclosed. Many modifications and variations are possible in light of the above teachings. Any or all features of the disclosed embodiments can be applied individually or in any combination, not meant to be limiting but purely illustrative. It is intended that the scope be limited by the claims appended herein and not with the detailed description.

What is claimed is:

1. A method, comprising:

energizing a piezoelectric drive element of an ejector using an ejector control unit configured to control the piezoelectric drive element to induce a pressure wave in an ink-fillable ejection chamber of the ejector, an intensity of the induced pressure wave being below a threshold value necessary to produce ejection of a normal sized ink drop by the ejector;

sensing a fluidic pressure response to the induced pressure wave and generating an electrical signal based on the sensing; and analyzing one or more characteristics of the electrical signal to determine ejection performance of the ejector.

2. The method of claim 1 wherein the ink jet head is a high resolution / multiple nozzle ink jet head.

3. The method of claim 1, wherein sensing the fluidic pressure response comprises self-sensing using the piezoelectric drive element.

4. The method of claim 1, wherein analyzing characteristics of the signal comprises detecting at least one of ink viscosity, nozzle blockage, insufficient ink supply to the ejection chamber, gas bubbles in the ejection chamber and ink supply channels, and wetting of the front face of the ink jet nozzle.

5. The method of claim 1, wherein analyzing the characteristics of the signal comprises analyzing the signal in at least one of time domain and frequency domain.

6. The method of claim 1, wherein the characteristics comprise at least one of time domain comparison to a known satisfactory signal, Fast Fourier Transform (FFT) central peak frequency, magnitude of oscillation damping, or FFT peak width.

7. The method of claim 1, wherein the energizing, sensing, and analyzing are performed during a time interval that occurs between printing of successive pages or when a print pattern calls for unprinted rows.

8. The method of claim 1, wherein the energizing, sensing, and analyzing are performed for an ink jet print head having about 880 nozzles during a time interval that occurs between printing of successive pages, the time interval being less than about 100 ms.

9. The method of claim 1, wherein analyzing further includes stopping the printing if an adverse problem is detected and sending an error message.

10. The method of claim 1, wherein energizing the piezoelectric drive element to induce the pressure wave comprises energizing the piezoelectric drive element at an energy level that is between about 80 percent and 20 percent of the energy level required to eject a normal sized ink drop.

11. The method of claim 1, wherein energizing the piezoelectric drive element to induce the pressure wave comprises modifying a time and voltage shape of a drive signal that energizes the piezoelectric drive element to provide optimal sensing of the fluidic pressure response and analysis of the one or more characteristics of the electrical signal.

12. An apparatus, comprising:

an ink-fillable ejection chamber of an ink ejector;

a nozzle fluidically connected to the ejection chamber;

a piezoelectric drive element coupled to the ink jet head ejection chamber and configured to generate a pressure wave below a threshold value necessary to produce an ejection of a normal sized ink drop through the nozzle;

an ejector control unit configured to control the piezoelectric drive element to generate the pressure wave below the threshold value;

a sensor configured to sense an ejection chamber fluidic pressure response to the induced pressure wave and to generate an electrical signal based on the sensed fluidic pressure response; and an analyzer configured to analyze one or more characteristics of the electrical signal to determine ejection performance of the ejector.

13. The apparatus of claim 12, wherein the sensor is the piezoelectric drive element operated in a sensing mode.

14. The apparatus of claim 12, wherein the analyzer is configured to detect at least one of ink viscosity, nozzle blockage, insufficient ink supply to the ejection chamber, gas bubbles in the ejection chamber and ink supply channels, and wetting of the front face of the ink jet nozzle.

15. The apparatus of claim 12, wherein the apparatus is configured to generate the pressure wave, sense the fluidic pressure response, and analyze the signal in less than about 100 ms.

16. The apparatus of claim 12, wherein the analyzer is configured to compare the electrical signal to a time domain characteristic waveform to determine the ejection performance.

17. The apparatus of claim 12, wherein the analyzer is configured to compare the electrical signal to a frequency domain signal to determine the ejection performance.

18. The apparatus of claim 12, wherein the analyzer is configured to compare one or both of a peak frequency or peak width of a Fast Fourier Transform (FFT) of the electrical signal to a predetermined threshold to determine the ejection performance.

19. An ink jet printer print head, comprising:

a print head including a plurality of ejectors, each ejector comprising:

an ink-fillable ejection chamber;

a nozzle fluidically connected to the ejection chamber;

a piezoelectric element coupled to the ejection chamber and configured to generate a pressure wave below a threshold value necessary to produce an ejection of a normal sized ink drop through the nozzle, to sense an ejection chamber fluidic pressure responsive to the induced pressure wave, and to generate an electrical signal based on the sensed fluidic pressure response;

an ejector control unit configured to control the piezoelectric drive element of the plurality of ejectors to generate the pressure wave below the threshold value; and an analyzer configured to analyze one or more characteristics of the electrical signal generated by the piezoelectric elements of the plurality of ejectors to determine print head ejection performance.

20. The print head of claim 19, wherein the analyzer is configured to compare the electrical signal of each ejector to one or more known time domain characteristic waveforms to determine the print head ejection performance.

21. The print head of claim 19, wherein the analyzer is configured to compare one or both of a peak frequency or peak width of a Fast Fourier Transform (FFT) of the electrical signal of each ejector to a predetermined threshold to determine the print head ejection performance.

* * * * *